US011004379B2

(12) United States Patent
Cho

(10) Patent No.: US 11,004,379 B2
(45) Date of Patent: May 11, 2021

(54) DISPLAY APPARATUS AND METHOD FOR GENERATING ENABLE SIGNAL USED IN THE SAME

(71) Applicant: RAONTECH, Inc., Seongnam-si (KR)

(72) Inventor: Je-Kwang Cho, Seoul (KR)

(73) Assignee: RAONTECH, INC.

( * ) Notice: Subject to any disclaimer, the term of this patent is extended or adjusted under 35 U.S.C. 154(b) by 158 days.

(21) Appl. No.: 16/119,433

(22) Filed: Aug. 31, 2018

(65) Prior Publication Data

US 2019/0073937 A1 Mar. 7, 2019

(30) Foreign Application Priority Data

Sep. 5, 2017 (KR) ..... 10-2017-0113360

(51) Int. Cl.
*G09G 3/20* (2006.01)

(52) U.S. Cl.
CPC ..... *G09G 3/2022* (2013.01); *G09G 3/2014* (2013.01); *G09G 2300/0842* (2013.01); *G09G 2310/0297* (2013.01); *G09G 2320/064* (2013.01); *G09G 2330/021* (2013.01)

(58) Field of Classification Search
None
See application file for complete search history.

(56) References Cited

U.S. PATENT DOCUMENTS

2002/0036611 A1* 3/2002 Ishii ..... G09G 3/3659 345/89
2003/0011552 A1* 1/2003 Ishii ..... G09G 3/3659 345/89
2003/0151582 A1* 8/2003 Ishii ..... G09G 3/3648 345/100
2019/0005904 A1* 1/2019 Mitsuzawa ..... G09G 3/3655
2020/0152147 A1* 5/2020 Mitsuzawa ..... G09G 3/3688

FOREIGN PATENT DOCUMENTS

KR 10-2002-0020210 A 3/2002

OTHER PUBLICATIONS

Korean Office Action issued by the KIPO dated Oct. 22, 2018, pp. 1-5.

* cited by examiner

*Primary Examiner* — Kent W Chang
*Assistant Examiner* — Benjamin Morales
(74) *Attorney, Agent, or Firm* — The Belles Group, P.C.

(57) ABSTRACT

A display apparatus may be provided that includes a plurality of pixels; a plurality of pixel memories which drive a corresponding pixel in accordance with a column signal when a scanning line selection signal and an enable signal are both selected; and a controller which generates the scanning line selection signal, the enable signal, and the column signal such that each of the pixels is driven in a turn-on time occupation ratio corresponding to a data value for each of the pixels, and then applies the signals to a corresponding pixel memory. According to the embodiment, in a display apparatus which requires high resolution, high frame rate per pixel, and high gray scale representation capability, the change of the signal which is applied to the pixel for each time slot is relatively reduced, so that consumption of power for driving the pixel can be reduced.

3 Claims, 11 Drawing Sheets

[FIG. 1]
PRIOR ART
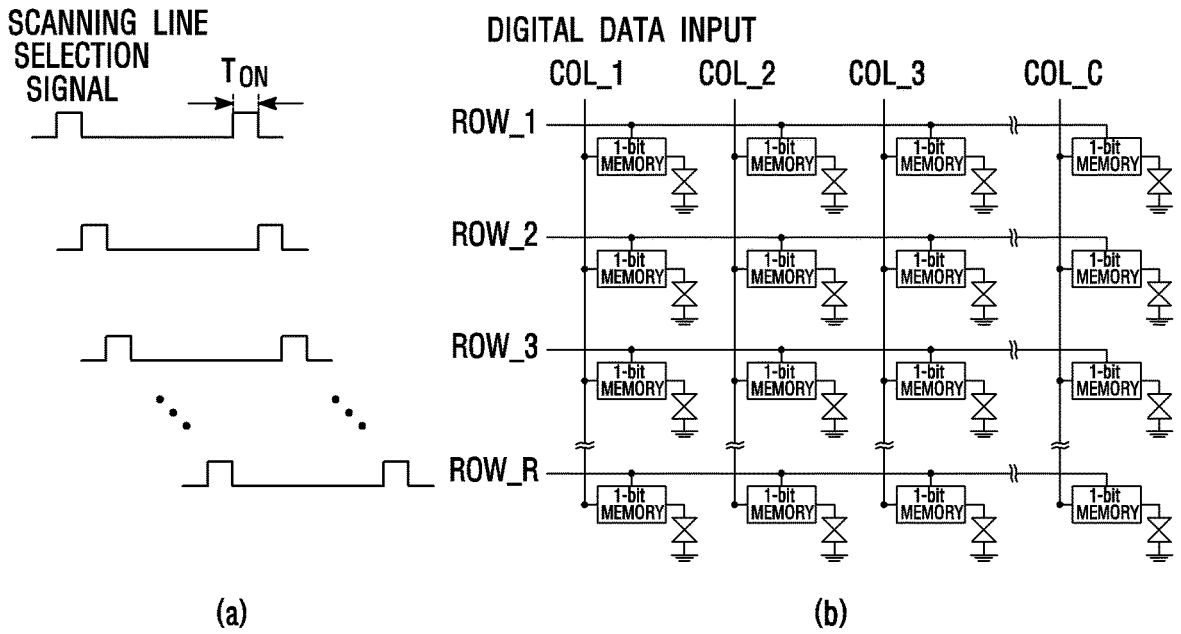

[FIG. 2]
PRIOR ART
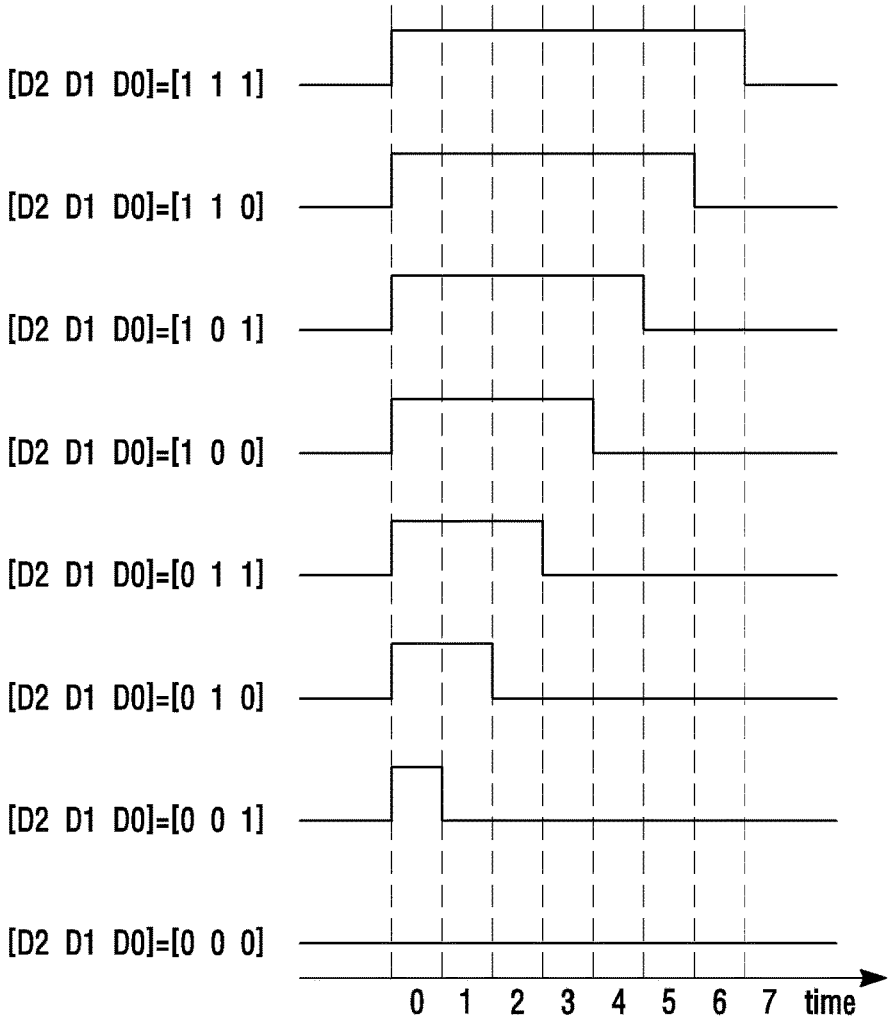

[FIG. 3a]
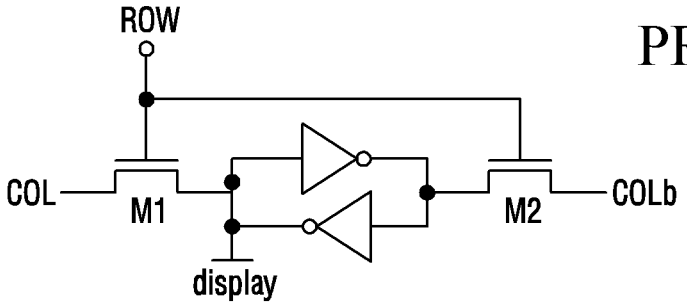
PRIOR ART
[FIG. 3b]
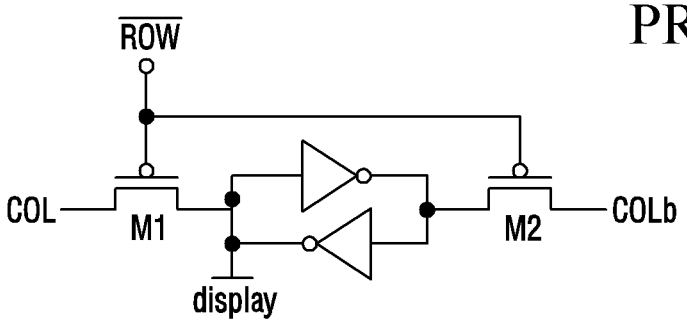
PRIOR ART

[FIG. 4]
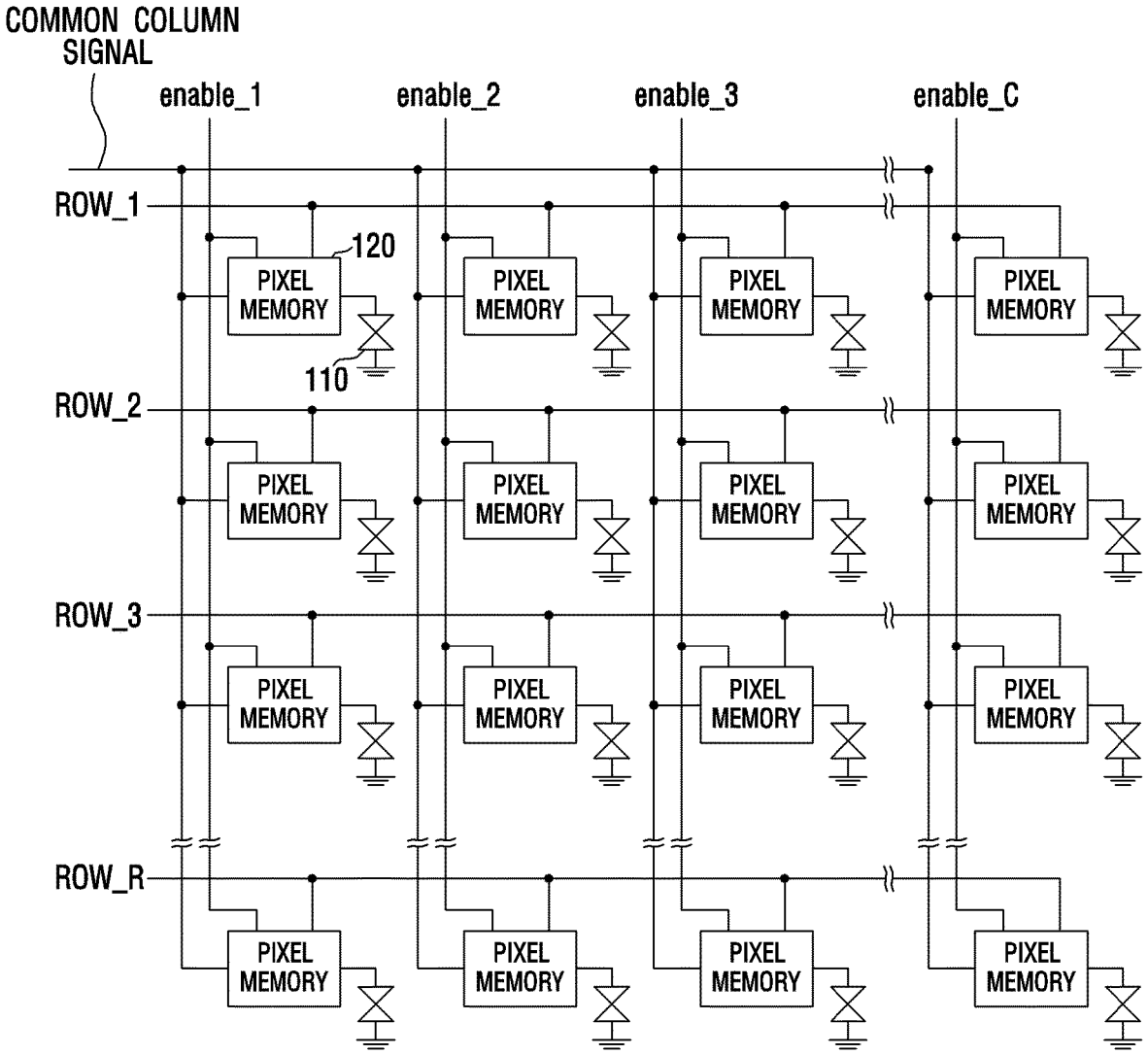

[FIG. 5a]
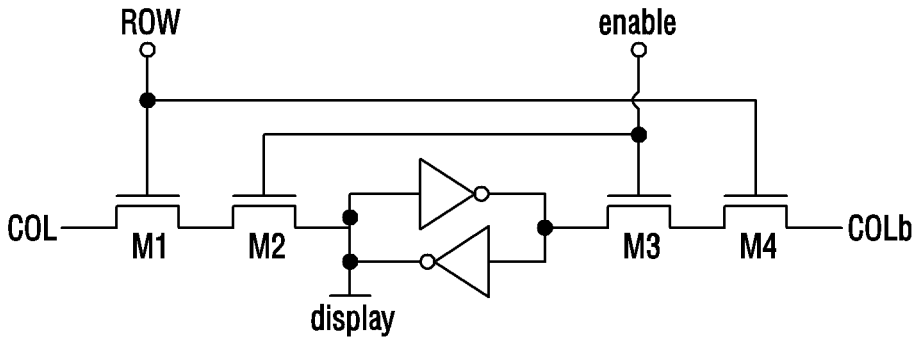
[FIG. 5b]
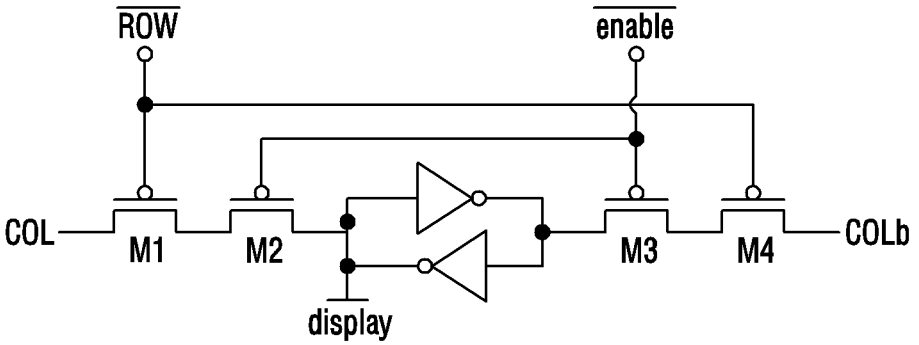

[FIG. 6]
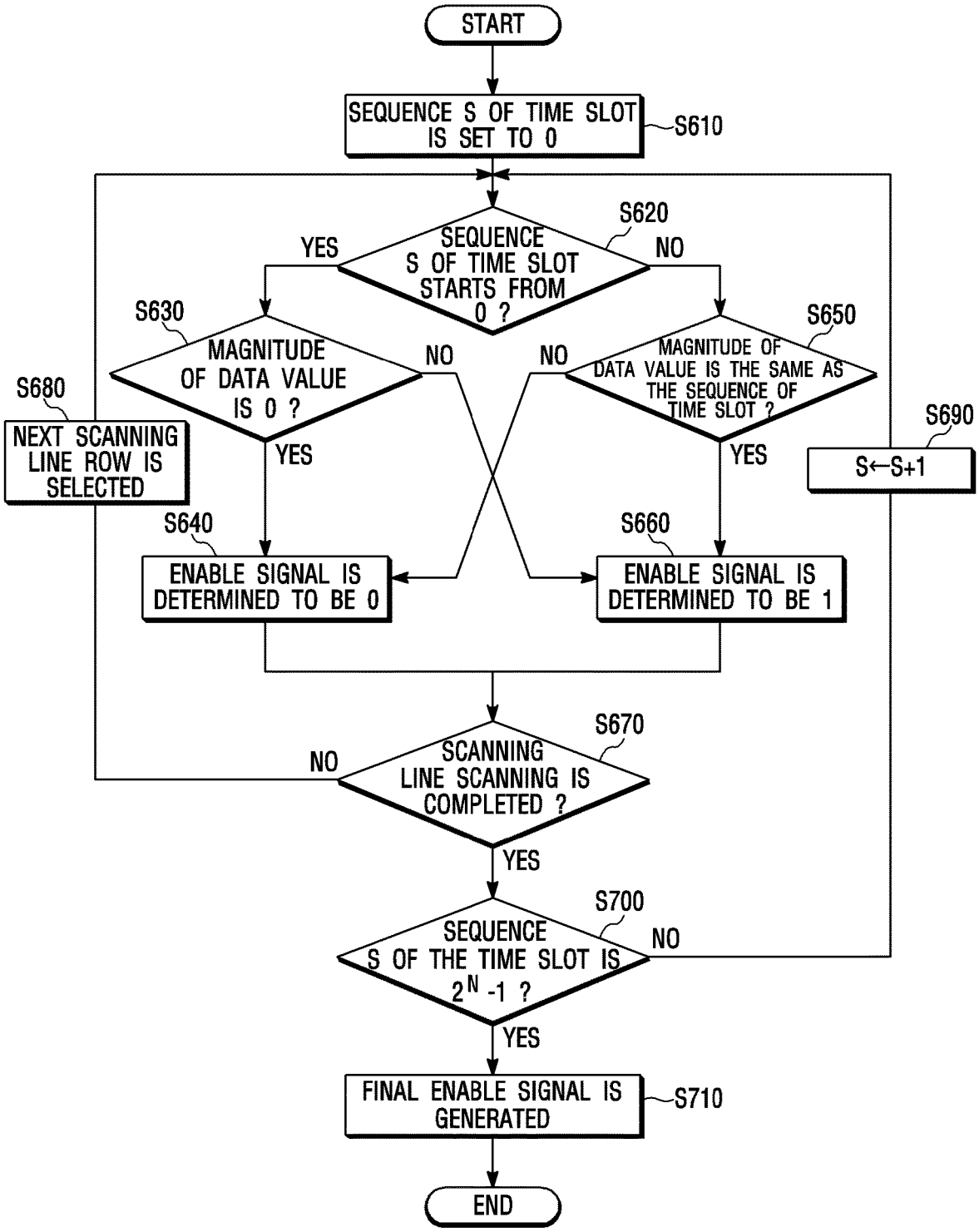

[FIG. 7]
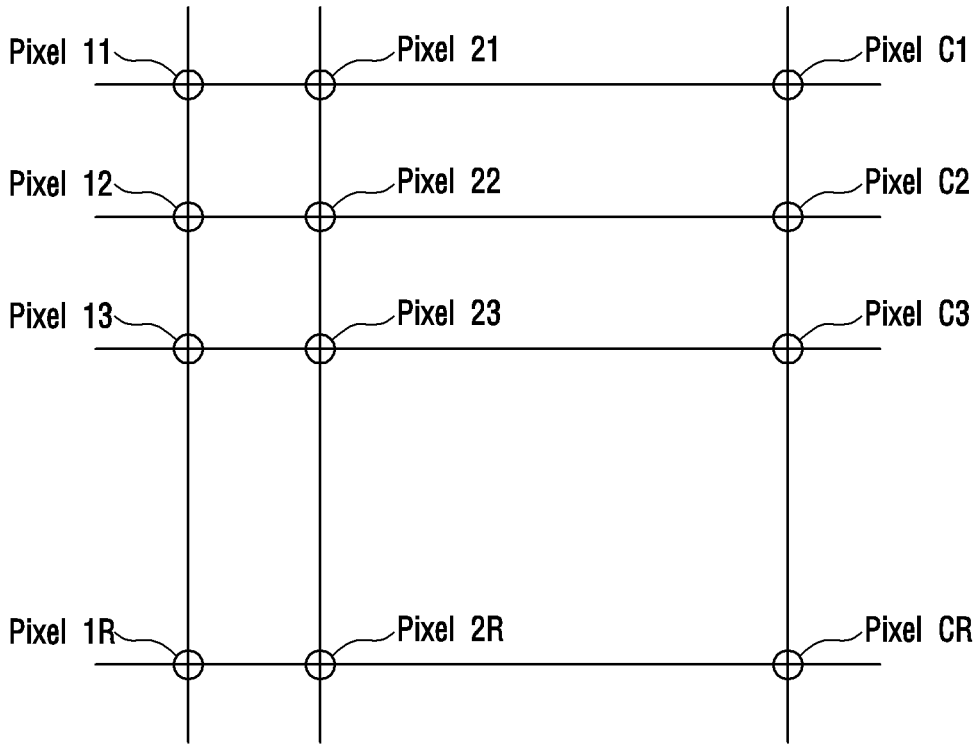

[FIG. 8]
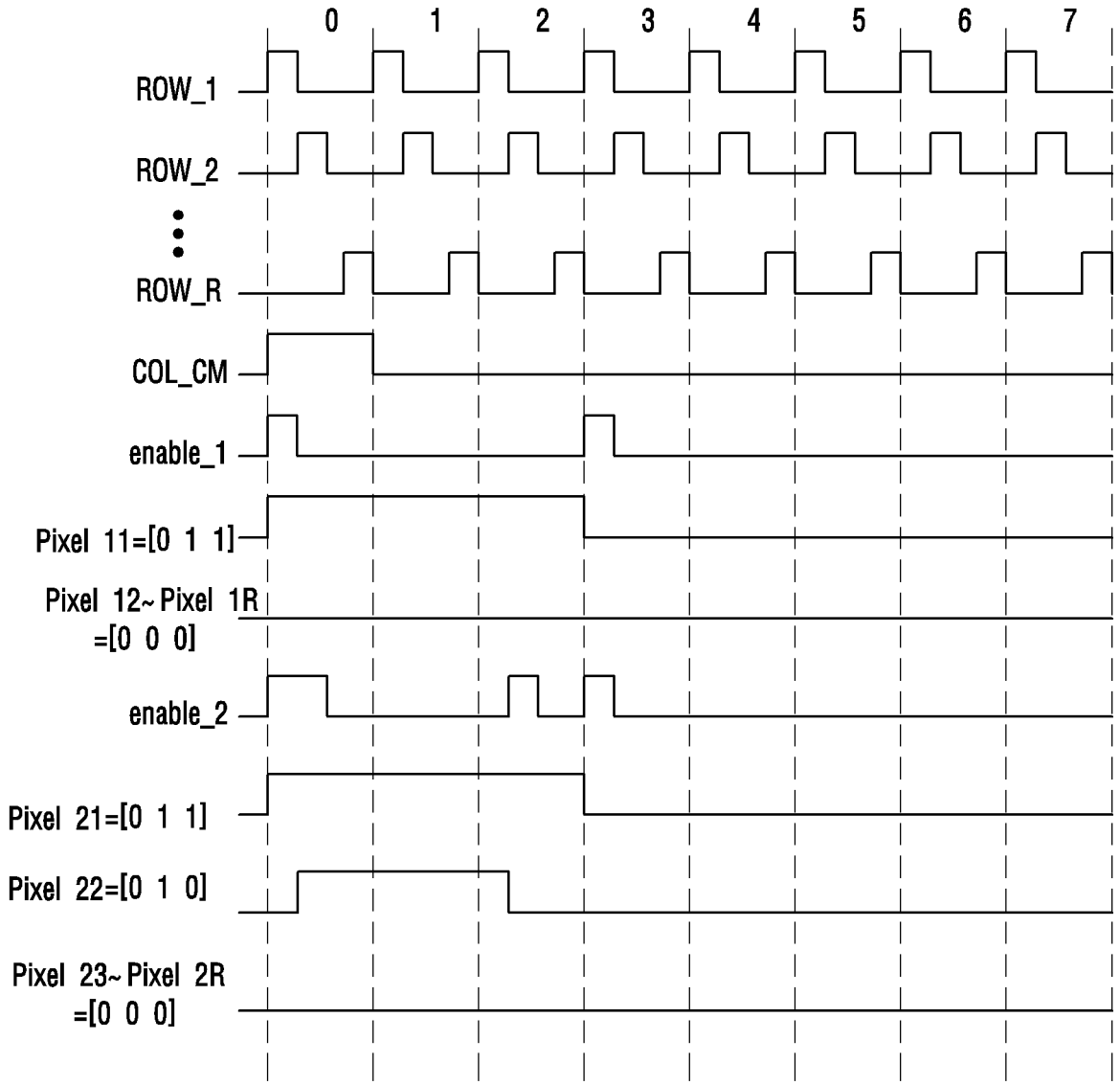

[FIG. 9]
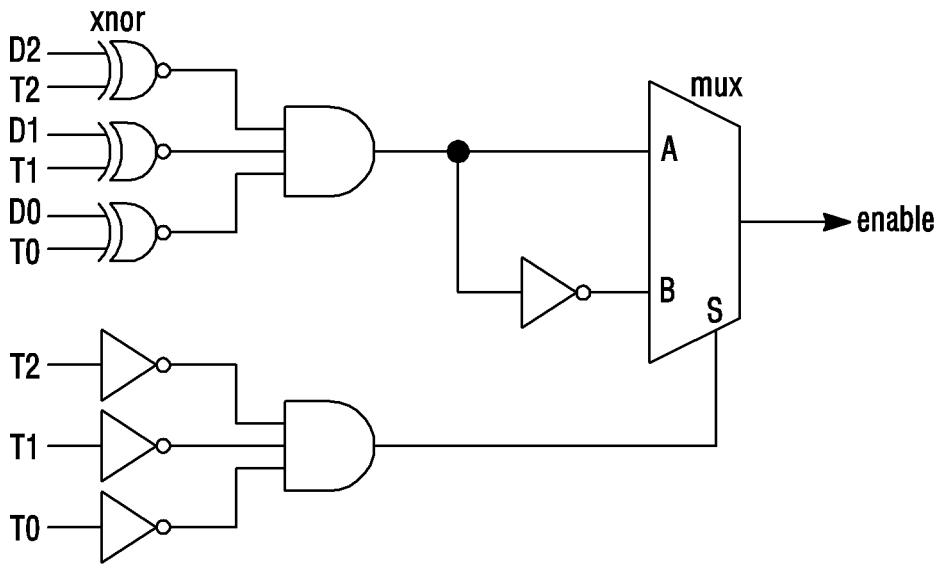

[FIG. 10]
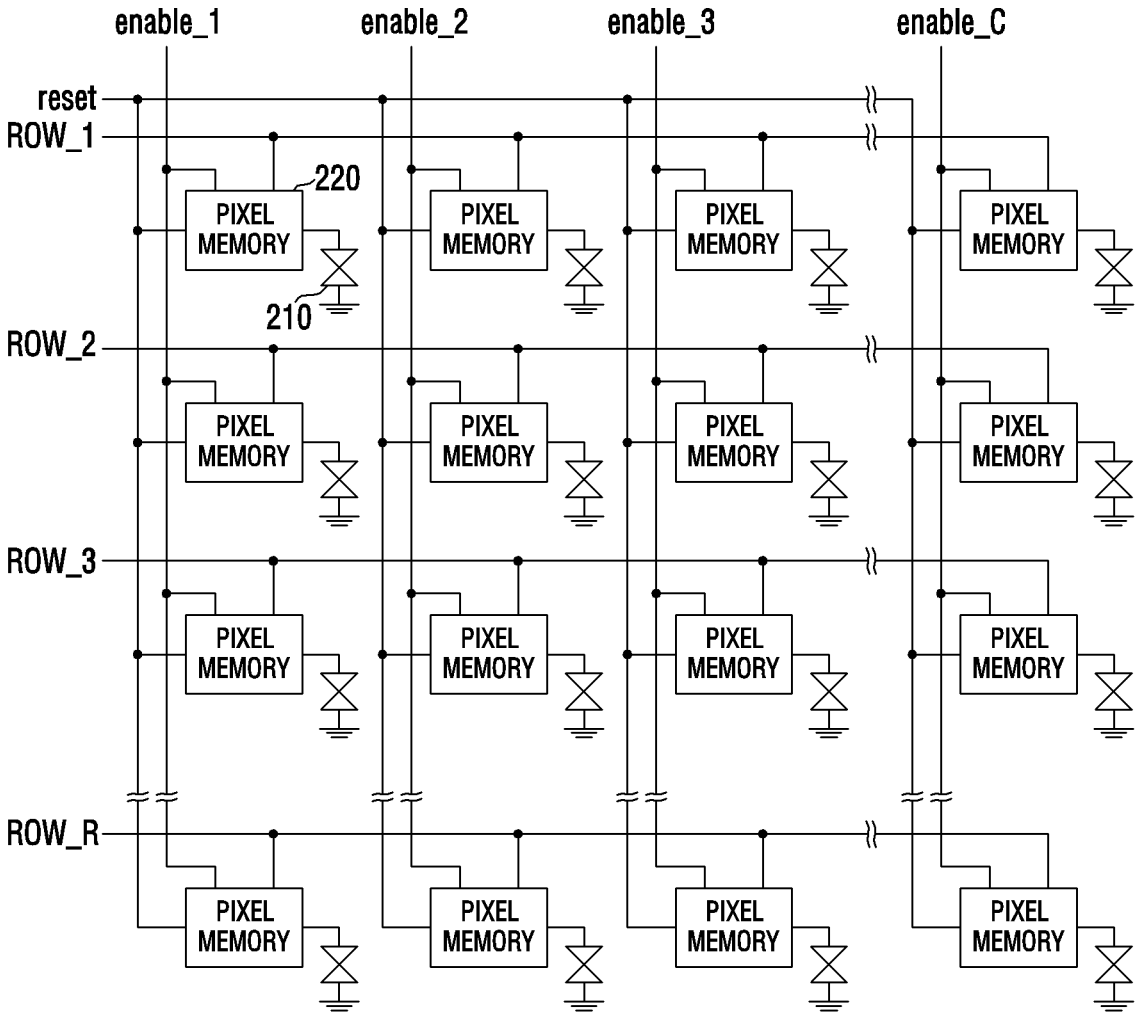
[FIG. 11]
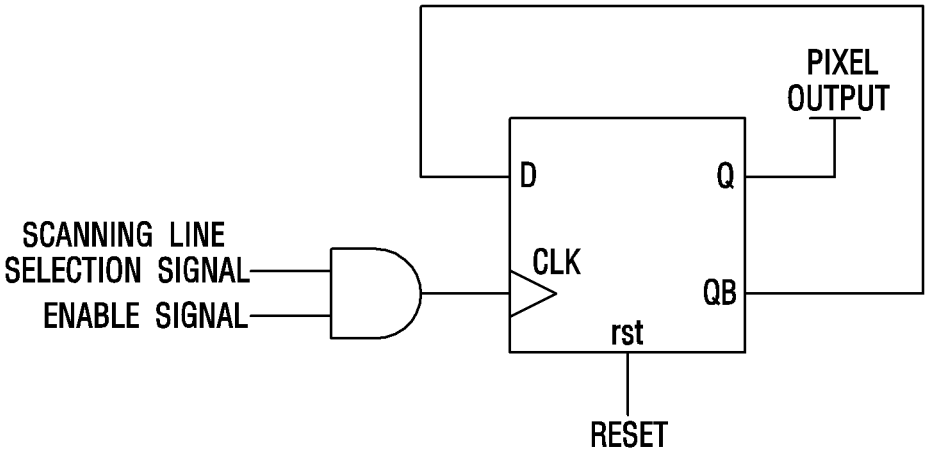

[FIG. 12]
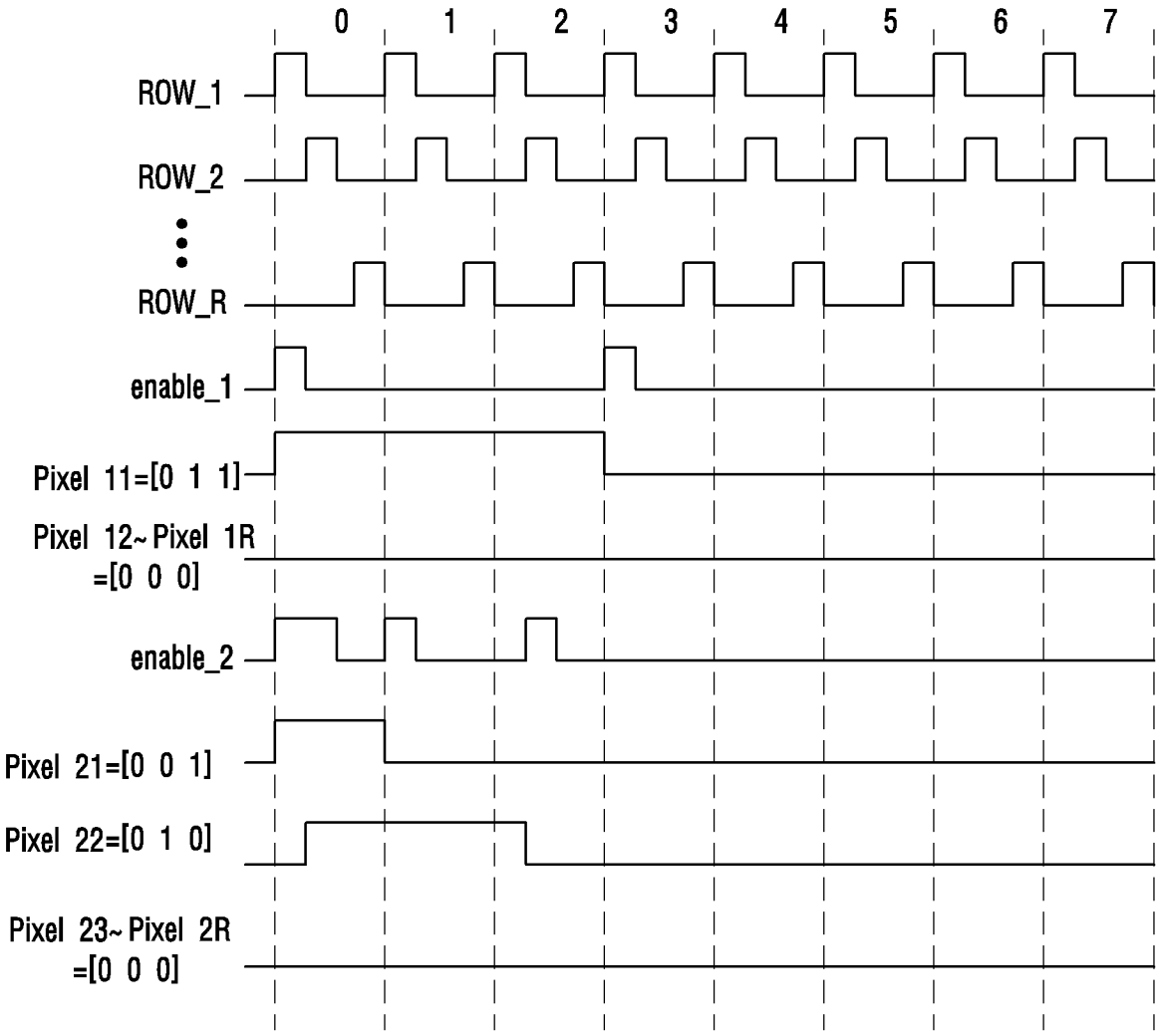

DISPLAY APPARATUS AND METHOD FOR GENERATING ENABLE SIGNAL USED IN THE SAME

CROSS REFERENCE TO RELATED APPLICATIONS

Priority is claimed under 35 U.S.C. § 119 to Korean Patent Application No. 10-2017-0113360, filed Sep. 5, 2017, the disclosure of which is incorporated herein by reference in its entirety.

BACKGROUND

Field

The present disclosure relates to a display apparatus and a method for generating an enable signal used in the display apparatus, and more particularly to a display apparatus which controls a turn-on occupation ratio of a pixel and a method for generating an enable signal used in the display apparatus.

Description of the Related Art

In general, a display apparatus displays an image on the display panel by using electrical and optical characteristics and includes a liquid crystal display (LCD), an organic light emitting diode (OLED) display, etc. Such a display apparatus has a structure in which a plurality of pixels are arranged in the form of a two-dimensional matrix of rows and columns.

Regarding the display apparatus which drives the pixel in a digital manner, an N-bit memory is included in each pixel, and the color of the screen is determined by the value of the memory. A method for storing a data value in the pixel memory will be described with reference to FIG. 1.

FIG. 1 is a view for describing a method for driving a digital pixel of a conventional display apparatus.

Referring to FIG. 1, the conventional display apparatus has a structure in which a plurality of pixels are arranged in R number of rows and C number of columns. In a conventional digital pixel driving method, an N-bit memory is included in each pixel and the color of the screen is determined according to the value of each memory. In many cases, N=1. The following description is limited to the case of N=1. However, even when N has other values, a similar description thereof will be possible from a conceptual viewpoint.

In the method for storing the value in the memory included in each pixel, on the basis of a scanning line selection signal ((a) of FIG. 1), a desired data value (0 or 1) may be applied to respective column lines COL_1 to COL_C ((b) of FIG. 1) while a row line is sequentially turned on from ROW_1 to ROW_R. Here, an application time ($T_{ON}$) of the scanning line selection signal of each row means a time obtained by dividing a unit time slot by the total number R of rows. Each row may be sequentially turned on for the time of $T_{ON}$. That is, a desired data value is applied to COL_1 to COL_C by turning ROW_1 on by the scanning line selection signal, so that the data value can be stored at each of the pixels where ROW_1 crosses COL_1 to COL_C respectively. Also, a desired data value is applied to COL_1 to COL_C by turning ROW_2 on after turning ROW_1 off, so that the data value can be stored at each of the pixels where ROW_2 crosses COL_1 to COL_C respectively. In the aforementioned manner, the data value can be sequentially stored in the memory included in the pixels of another row, or stored data value can be changed.

Regarding a digital pixel driving method, the brightness of each pixel of the display apparatus can be controlled by the time occupation ratio difference between "0" and "1" stored in the pixel memory, and the brightness of the entire display panel can be controlled by the occupied area ratio between "0" and "1" of the plurality of pixels.

When the display apparatus is driven by using a binary N-bit digital signal, a high quality display image can be output by transmitting the data value of an input image signal in the form of one pulse of which only the widths are different. Specifically, when the display apparatus is driven by single-pulse pulse width modulator (PWM) method, the quality of the image can be improved. For this, a binary N-bit signal is converted into a thermometer $(2^N-1)$-bit signal, and then a certain period of time is assigned to each bit to drive the display apparatus. According to this method, "1"s of the converted signal are grouped from the front or rear and then the display apparatus is driven irrespective of the input binary signal value only by one pulse of which only the widths are different. Therefore, this method is advantageous for improving the digital display image quality.

FIG. 2 is a view for describing a conventional single-pulse PWM signal.

Referring to FIG. 2, the conventional single-pulse PWM signal is generated such that only a point where the pulse ends is changed according to the input data value.

In the transmission of an N-bit digital signal to the pixel, in order to obtain an image output of the display apparatus with high image quality, one pulse is used according to the value of the input image signal. Here, it is common to generate the signal by using the single-pulse PWM method or the single-pulse pulse-width modulator which changes only the pulse width. For this, when an N-bit binary signal is converted to a $(2^N-1)$-bit thermometer signal, it can be represented by a PWM signal having consecutive "1"s.

Specifically, when a decimal data value of a 3-bit input signal is 0, there is no need to generate a pulse, and when the decimal data value of the 3-bit input signal is not 0, high is applied in the first time slot, and then a signal may be generated to determine a point of time when the signal becomes low in accordance with the magnitude of the data value. That is, when the magnitude of the data value is 1, a signal may be generated such that high is applied in the first time slot and low is applied from in the second time slot, and when the magnitude of the data value is 3, a signal may generated such that high is applied from in the first to in the third time slot and low is applied from in the fourth time slot. Through the generation of such a PWM signal, the display apparatus can be driven by controlling the turn-on occupation ratio of each pixel in accordance with the magnitude of the data value.

FIGS. 3*a* to 3*b* are circuit diagrams for schematically describing the operating principle of a conventional pixel memory.

Referring to FIGS. 3*a* to 3*b*, the conventional pixel memory can be implemented by using NMOS or PMOS transistor as a switch.

The pixel memory implemented with the NMOS transistor may store a column signal COL in the pixel when the scanning line selection signal ROW becomes high and the pixel memory implemented with the PMOS transistor is turned on when the gate is low, so that the pixel memory is driven by an inverted scanning line selection signal. Here, the NMOS transistor and the PMOS transistor can function as a switch.

In the use of the conventional pixel memory, when the scanning line selection signal ROW is high, high or a low is stored in the pixel according to the column signal COL. As the scanning line selection signal of FIG. 1 scans each row from the top to the bottom, the column signal is continuously changed according to the data value of the pixel.

In the transmission of the N-bit digital signal to the pixel, in order to output a high quality display image, a PWM method which uses one pulse according to the value of the input image signal is used. To this end, it is common to convert the N-bit binary signal into the $(2^N-1)$-bit thermometer signal, to output "1" as much as the data value as a group, and to output "0".

When the pixel driving method of FIG. 1 is used to generate a pulse of such a column signal, the value of the COL line frequently changes as the ROW line is scanned, which causes a problem of high power consumption.

BRIEF SUMMARY

In order to overcome the above-mentioned problems, the purpose of the present invention is to provide a display apparatus which reduces the number of changes of a data value of a column (COL) line and transmits a desired data value to each pixel, and a digital pixel driving method which drives the same.

One embodiment is a display apparatus that includes: a plurality of pixels; a plurality of pixel memories which are provided for the plurality of pixels respectively and drive a corresponding pixel in accordance with a column signal when a scanning line selection signal and an enable signal are both selected; and a controller which generates the scanning line selection signal, the enable signal, and the column signal such that each of the pixels is driven in a turn-on time occupation ratio corresponding to a data value for each of the pixels, and then applies the signals to a corresponding pixel memory.

The plurality of pixels may be arranged in the form of a matrix of R number of rows and C number of columns, an r-th scanning line selection signal and a c-th enable signal line may be connected to the pixel memory for driving the pixel arranged in an r-th row and a c-th column, and a common column signal line may be connected to all the pixel memories. When the data value is composed of N bits, the controller may divide time allocated to control each pixel into $2^N$ time slots, and may generate the column signal which is high only during a first time slot and an r-th scanning line selection signal which is high only during an r-th time interval among the time intervals obtained by dividing each time slot equally into R portions, and the controller may generate the enable signal which is low during the entire time slot in the pixel memory for the pixel having the data value of 0, and may generate the enable signal which is high only during the r-th time interval corresponding to the scanning line selection signals of the first time slot and the (k+1)-th time slot, in the pixel memory for the pixel having the data value of k.

Each of the plurality of pixel memories may include a first NMOS transistor, a second NMOS transistor, an inverter memory, a third NMOS transistor, and a fourth NMOS transistor which are connected in-series. The scanning line selection signal of the corresponding pixel may be applied to gate terminals of the first NMOS transistor and the fourth NMOS transistor. The enable signal of the corresponding pixel may be applied to gate terminals of the second NMOS transistor and the third NMOS transistor. A common column signal may be applied to a drain terminal of the first NMOS transistor. An inverted common column signal may be applied to a source terminal of the fourth NMOS transistor, and a signal temporarily stored in the inverter memory is transmitted to the pixel.

Each of the plurality of pixel memories may include a first NMOS transistor, a second NMOS transistor, an inverter memory, a third NMOS transistor, and a fourth NMOS transistor which are connected in-series. An inverted scanning line selection signal of the corresponding pixel may be applied to gate terminals of the first NMOS transistor and the fourth NMOS transistor. An inverted enable signal of the corresponding pixel may be applied to gate terminals of the second NMOS transistor and the third NMOS transistor. A common column signal may be applied to a source terminal of the first NMOS transistor. An inverted common column signal may be applied to a drain terminal of the fourth NMOS transistor, and a signal temporarily stored in the inverter memory is transmitted to the pixel.

The controller may include a multiplexer and at least one logic circuit. The controller may generate the enable signal by a process in which a sequence of each time slot is converted into N bits, each bit is calculated and is input as a selection signal of the multiplexer and a first calculated value which is obtained by calculating an N bit data value and each bit of the sequence of the N bit time slot by at least one logic circuit and a second calculated value which is obtained by calculating by at least one logic circuit are used as an input value of the multiplexer.

Another embodiment is a display apparatus that includes: a plurality of pixels; a plurality of pixel memories which are provided for the plurality of pixels respectively and drive a corresponding pixel by changing an input signal when a scanning line selection signal and an enable signal are both selected; and a controller which applies the scanning line selection signal and the enable signal to a corresponding pixel memory such that each of the pixels is driven in a turn-on time occupation ratio corresponding to a data value for each of the pixels.

The plurality of pixels may be arranged in the form of a matrix of R number of rows and C number of columns. An r-th scanning line selection signal and a c-th enable signal line may be connected to the pixel memory for driving the pixel arranged in an r-th row and a c-th column. When an initial input signal is set to low and the data value is composed of N bits, the controller may divide time allocated to control each pixel into $2^N$ time slots. The controller may generate the r-th scanning line selection signal which is high only during an r-th time interval among time intervals obtained by dividing each time slot equally into R portions, may generate an enable signal which is low during the entire time slot in the pixel memory for the pixel having the data value of 0, and may generate the enable signal which is high only during a time interval corresponding to the scanning line selection signals of a first time slot and a (k+1)-th time slot, in the pixel memory for the pixel having the data value of k.

The plurality of pixel memories may be connected to a common reset signal line to periodically apply a reset signal.

Each of the plurality of pixel memories may be composed of a T flip-flop or a D flip-flop and an AND gate.

The controller may include a multiplexer and at least one logic circuit. The controller may generate the enable signal by a process in which a sequence of each time slot is converted into N bits, each bit is calculated and is input as a selection signal of the multiplexer and a first calculated value which is obtained by calculating an N bit data value and each bit of the sequence of the N bit time slot by at least one logic circuit and a second calculated value which is obtained by calculating by at least one logic circuit are used as an input value of the multiplexer.

According to the embodiment, in a display apparatus which requires high resolution, high frame rate per pixel, and high gray scale representation capability, the change of the signal which is applied to the pixel for each time slot is relatively reduced, so that consumption of power for driving the pixel can be reduced.

According to the embodiment, power consumption can be reduced by minimizing the total signal change within the display apparatus.

BRIEF DESCRIPTION OF THE DRAWINGS

FIG. 1 is a view for describing a method for driving a digital pixel of a conventional display apparatus;

FIG. 2 is a view for describing a conventional single-pulse PWM signal;

FIGS. 3*a* to 3*b* are circuit diagrams for schematically describing the operating principle of a conventional pixel memory;

FIG. 4 is a schematic configuration view of a display apparatus according to a first embodiment of the present invention;

FIGS. 5*a* to 5*b* are circuit diagrams for schematically describing the operating principle of a pixel memory of the display apparatus according to the first embodiment of the present invention;

FIG. 6 is a flowchart for schematically describing a method for generating an enable signal for driving the display apparatus according to the first embodiment of the present invention;

FIGS. 7 to 8 are views for describing a pixel drive signal of the display apparatus according to the first embodiment of the present invention;

FIG. 9 is a logic circuit which generates the enable signal of the display apparatus according to the first embodiment of the present invention;

FIG. 10 is a schematic configuration view of a display apparatus according to a second embodiment of the present invention;

FIG. 11 is a circuit diagram for schematically describing the operating principle of a pixel memory of the display apparatus according to the second embodiment of the present invention; and FIG. 12 is a view for describing a pixel drive signal of the display apparatus according to the second embodiment of the present invention.

DETAILED DESCRIPTION

Hereinafter, embodiments disclosed in this specification will be described in detail with reference to the accompanying drawings. The same or similar elements will be denoted by the same reference numerals irrespective of drawing numbers, and repetitive descriptions thereof will be omitted. A suffix "part" for the component, which is used in the following description, is given or mixed in consideration of only convenience for ease of specification, and does not have any distinguishing meaning or function per se.

Also, in the following description of the embodiment disclosed in the present specification, the detailed description of known technologies incorporated herein is omitted to avoid making the subject matter of the embodiment disclosed in the present specification unclear. Also, the accompanied drawings are provided only for more easily describing the embodiment disclosed in the present specification. The technical spirit disclosed in the present specification is not limited by the accompanying drawings. All modification, equivalents and substitutes included in the spirit and scope of the present invention are understood to be included in the accompanying drawings.

While terms including ordinal numbers such as the first and the second, etc., can be used to describe various components, the components are not limited by the terms mentioned above. The terms are used only for distinguishing between one component and other components.

In the case where a component is referred to as being "connected" or "accessed" to other component, it should be understood that not only the component is directly connected or accessed to the other component, but also there may exist another component between them. Meanwhile, in the case where a component is referred to as being "directly connected" or "directly accessed" to other component, it should be understood that there is no component therebetween. An expression of a singular form includes the expression of plural form thereof unless otherwise explicitly mentioned in the context.

In the present specification, it should be understood that the term "include" or "comprise" and the like is intended to specify characteristics, numbers, steps, operations, components, parts or any combination thereof which are mentioned in the specification, and intended not to previously exclude the possibility of existence or addition of at least one another characteristics, numbers, steps, operations, components, parts or any combination thereof.

Hereinafter, the embodiment according to the present invention will be described in detail with reference to the accompanying drawings.

FIG. 4 is a schematic configuration view of the display apparatus according to a first embodiment of the present invention.

Referring to FIG. 4, the display apparatus according to the first embodiment of the present invention may include a plurality of pixels 110, a plurality of pixel memories 120, and a controller (not shown).

First, the plurality of pixels 110 may be arranged in the form of a matrix of C number of columns and R number of rows. Each pixel 110 has a constant area and may be turned on or off according to a pixel drive signal. The gradation of the pixel can be determined according to the occupation ratio (time or area) of "1" or "0" of each pixel 110. For example, the more "0", the closer the gradation is to black, and the more "1", the closer the gradation is to white. Alternatively, depending on the material constituting each pixel 110 or voltage, conversely the more "0", the closer the gradation is to white, and the more the "1'", the closer the gradation is to black.

The plurality of pixel memories 120 are provided for each pixel 110, and when a scanning line selection signal and an enable signal are both selected, a display device of the corresponding pixel can be driven according to a column signal. That is, one pixel memory 120 is provided for each pixel 110, and the r-th scanning line selection signal and the c-th enable signal line are connected to the pixel memory 120 for driving the pixel 110 arranged in the r-th row and the c-th column. A common column signal line may be connected to all the pixel memories. Here, when the scanning line selection signal and the enable signal which are applied to the pixel memory 120 are both selected (all signals are "high"), the corresponding pixel can be driven according to the column signal. Each pixel memory 120 may be composed of a plurality of transistors and an inverter. Here, the plurality of transistors can function as a switch.

FIGS. 5*a* to 5*b* are circuit diagrams for schematically describing the operating principle of the pixel memory of the display apparatus according to the first embodiment of the present invention.

Referring to FIG. 5*a*, each pixel memory 120 may include four NMOS transistors and an inverter memory. Specifically, each pixel memory 120 may include a first NMOS transistor M1, a second NMOS transistor M2, the inverter memory, a third NMOS transistor M3, and a fourth NMOS transistor M4 which are connected in-series. Here, the scanning line selection signal ROW of the corresponding pixel may be applied to the gate terminals of the first NMOS transistor M1 and the fourth NMOS transistor M4, and the enable signal (enable) of the corresponding pixel may be applied to the gate terminals of the second NMOS transistor M2 and the third NMOS transistor M3. Also, the common column signal COL may be applied to the drain terminal of the first NMOS transistor M1, and the inverted common column signal COLb may be applied to the source terminal of the fourth NMOS transistor M4. A signal temporarily stored in the inverter memory may be transmitted to the pixel display device. Here, the inverter memory may be composed of two inverter circuits. Accordingly, when the scanning line selection signal ROW and the enable signal (enable) are both selected ("1" or the "high" signal), the first to fourth NMOS transistors M1 to M4 are all turned on, the column signal COL is transmitted to the pixel display device. Meanwhile, when at least one of the scanning line selection signal ROW or the enable signal (enable) is not selected (the "0" or the "low" signal), at least one of the first to fourth NMOS transistors M1 to M4 is turned off, and thus, the column signal COL is not transmitted to the pixel display device. Therefore, the previously transmitted column signal is held in the pixel display device. Even if the positions to which the scanning line selection signal ROW and the enable signal (enable) of FIG. 5*a* are applied are interchanged, the operating principle is the same.

Referring to FIG. 5*b*, each pixel memory 120 may include four PMOS transistors and the inverter memory. Specifically, each pixel memory 120 may include a first PMOS transistor M1, a second PMOS transistor M2, the inverter memory, a third PMOS transistor M3, and a fourth PMOS transistor M4 which are connected in-series. In each pixel memory 120, an inverted scanning line selection signal of the corresponding pixel may be applied to the gate terminals of the first PMOS transistor M1 and the fourth PMOS transistor M4, and an inverted enable signal of the corresponding pixel may be applied to the gate terminal of the second PMOS transistor M2 and the third PMOS transistor M3. In addition, the common column signal may be applied to the source terminal of the first PMOS transistor M1, and the inverted common column signal may be applied to the drain terminal of the fourth PMOS transistor M4. A signal temporarily stored in the inverter memory may be transmitted to the pixel display apparatus. Accordingly, when the scanning line selection signal ROW and the enable signal (enable) are both selected ("1" or the "high" signal), the first to fourth PMOS transistors M1 to M4 are all turned on, the column signal is transmitted to the pixel display device. Meanwhile, when at least one of the scanning line selection signal ROW or the enable signal (enable) is not selected (the "0" or the "low" signal), at least one of the first to fourth PMOS transistors M1 to M4 is turned off, and thus, the column signal is not transmitted to the pixel display device. Therefore, the previously transmitted column signal is held in the pixel display device. Even if the positions to which the scanning line selection signal ROW and the enable signal (enable) of FIG. 5*b* are applied are interchanged, the operating principle is the same.

The NMOS transistor or the PMOS transistor included in FIGS. 5*a* to 5*b* can function as a switch.

The circuit configuration of the pixel memory 120 is only an embodiment, and when the scanning line selection signal ROW and the enable signal (enable) are both selected (all "high" signal), the pixel memory may be configured with various circuit elements such that the pixel can be driven according to the column signal.

The controller (not shown) generates the scanning line selection signal, the enable signal, and the column signal such that each pixel 110 is driven in a turn-on time occupation ratio corresponding to a data value for each pixel 110. Then, the controller (not shown) may apply the signals to the corresponding pixel memory 120. Specifically, when the data value is composed of N bits, the controller divides the time allocated to control each pixel into $2^N$ time slots, and may generate the column signal which is high only during the first time slot and an r-th scanning line selection signal which is high only during the r-th time interval among the time intervals obtained by dividing each time slot equally into R portions. Also, the controller may generate an enable signal which is low during the entire time slot in the pixel memory for the pixel having the data value of 0, and may generate an enable signal which is high only during the r-th time interval corresponding to the scanning line selection signals of the first time slot and the (k+1)-th time slot, in the pixel memory for the pixel having the data value of k. The controller may include a multiplexer and at least one logic circuit. The controller may generate the enable signal by a process in which the sequence of each time slot is converted into N bits, each bit is calculated and is input as a selection signal of the multiplexer and a first calculated value which is obtained by calculating an N bit data value and each bit of the sequence of the N bit time slot by at least one logic circuit and a second calculated value which is obtained by calculating by at least one logic circuit are used as an input value of the multiplexer. The configuration of the controller and the method for generating the enable signal are only examples, and the controller can be configured with various circuit elements may be used, and various methods for generating signals can be used.

Hereinafter, the method for generating the scanning line selection signal, the enable signal, and the column signal and a pixel driving method according to the embodiment of the present invention will be described with reference to the accompanying drawings.

FIG. 6 is a flowchart for schematically describing the method for generating the enable signal for driving the display apparatus according to the first embodiment of the present invention.

Referring to FIG. 6, according to the method for generating the enable signal for driving the display apparatus according to the first embodiment of the present invention, while the sequence of the time slot is sequentially increased from 0, the enable signal can be generated according to the pixel data value of each row by scanning line scanning.

The enable signal generating method according to the first embodiment of the present invention generates the enable signals enable_1, enable_2, . . . , enable_c of respective columns. After the enable signals of the plurality of pixels included in the same column are respectively determined, a final enable signal enable_c of each column is generated by coupling the enable signals. Here, the method for generating the enable signal means a method for generating the enable signal of each pixel included in the same column. The following description will be provided as an example in which the logic is set to "1" when the pixel is enabled and the logic is set to "0" when the pixel is disabled. However, the logic circuit can be configured to have the opposite logic value thereto.

Specifically, the sequence S of the time slot is initially set to 0 (S610), and it is determined whether the sequence S of the time slot starts from 0 or not (S620). It is determined whether the sequence of the time slot is 0 or not and the magnitude of the data value is 0 or not (S630). If the magnitude of the data value is 0 (YES), the enable signal is determined to be 0 (S640). If the sequence of the time slot is 0 and the magnitude of the data value is not 0 (NO), the enable signal is determined to be 1 (S660).

If the sequence of the time slot is not 0 (NO), it is determined whether or not the magnitude of the data value is the same as the sequence of the time slot (S650). If the magnitude of the data value is the same as the sequence of the time slot (YES), the enable signal is determined to be 1 (S660). If it is not the same, the enable signal is determined to be 0 (S640). Here, if the data value is composed of N bits, the sequence of time slot may be divided into $2^N$ time slots from 0 to $2^N-1$. Therefore, when the magnitude of the data value is 3, the enable signals of the 0-th time slot and the third time slot may be determined to be 1.

It is determined whether or not the enable signal determination is made for all the scanning lines, that is, the scanning line scanning is completed (S670). If the scanning line scanning is not completed (NO), the next scanning line ROW is selected (S680) and the steps from S620 to S670 may be repeatedly performed. Here, the scanning line scanning means a process of sequentially selecting R number of rows by the scanning line selection signal when the plurality of pixels are arranged in the form of a matrix of R number of rows and C number of columns. The completion of the scanning line scanning means that R number of rows have been all selected during one time slot. When the scanning line scanning is completed (YES), it is determined whether or not the sequence S of the time slot is $2^N-1$ (S700). When the sequence S of the time slot is $2^N-1$, the final enable signal can be generated by coupling the generated enable signals (S710). Meanwhile, when the sequence S of the time slot is not $2^N-1$, the enable signal of the next time slot can be generated by increasing the sequence S of the time slot to S+1 (S690).

The above-described enable signal generating method can be applied in the same manner to the enable signal of the display apparatus according to a second embodiment of the present invention. With reference to FIGS. 7 to 8, a method for generating the enable signal enable_c of each column will be described in detail.

FIGS. 7 to 8 are views for describing the pixel drive signal of the display apparatus according to the first embodiment of the present invention.

Referring to FIG. 7, the scanning line selection signal ROW of the display apparatus according to the first embodiment of the present invention is a signal for selecting each row of the plurality of pixels composed of R number of rows and C number of columns. The column signal COL means a signal which is applied to a pixel corresponding to each column when each row is selected.

The scanning line selection signal ROW is configured to select each row for a 1/R time period obtained by dividing one time slot by R number of rows and to select the next row for the next 1/R time period. The column signal COL is a signal for selecting a pixel in a specific column during a time when the scanning line selection signal is applied to each row, and COL_1 is a signal for selecting a pixel in the first column. For example, the common column signal is applied to the pixel (Pixel 11) of the first column during a time when the scanning line selection signal ROW_1 is applied to the first row, and the data of the column signal is applied to the pixel (Pixel 12) of the first column during a time when the scanning line selection signal ROW_2 is applied to the second row.

Referring to FIG. 8, the pixel drive signal of the display apparatus according to the first embodiment of the present invention includes the scanning line selection signals ROW_1 to ROW_R for selecting respective rows, a common column signal COL_CM, and enable signals enable_1 to enable_C). In FIG. 8, for convenience, portions corresponding to ROW_3 to ROW_(R−1) are compressed and displayed for each time slot.

In the scanning line selection signals ROW_1 to ROW_R for selecting each row, each of the slots 0, 1, 2, 3, 4, 5, 6 and 7 is equally divided into R portions, and the scanning line selection signal ROW_1 for selecting the first row shows a repeating pattern in which a high signal is output only during the first 1/R time interval of each time slot and a low signal is output during the remaining (R−1)/R time interval. Also, the scanning line selection signal ROW_2 for selecting the second row shows a repeating pattern in which a high signal is output only during the second 1/R time interval of each time slot and a low signal is output during the remaining (R−1)/R time interval. Likewise, the scanning line selection signal ROW_r for selecting the r-th row shows a repeating pattern in which a high signal is output only during the r-th 1/R time interval of each time slot and a low signal is output during the remaining (R−1)/R time interval.

When the data value is composed of N bits, the time allocated to control each pixel is divided into $2^N$ time slots to represent the data value by the turn-on time occupation ratio of the pixel. Specifically, when the data value is composed of 3 bits, the time allocated to control each pixel is divided into 8 time slots 0, 1, 2, 3, 4, 5, 6, and 7, so that the pixel can be controlled.

According to the embodiment of the present invention, in order to control each pixel, the common column signal COL_CM may be generated as a high signal only during the first time slot of the $2^N$ time slots and as a low signal during the remaining time slots.

The enable signals enable_1 to enable_C are low signals during the entire time slot when the data value is 0 in accordance with the data value, and are high signals only during the r-th time interval corresponding to the scanning line selection signals of the first time slot and the (k+1)-th time slot in the pixel memory for the pixel having the data value k. Here, the enable signals enable_1 to enable_C may be applied to each column in a form of coupled enable signals to be applied to the plurality of pixels included in the same column. That is, the enable signal enable_1 to be applied to the first column may be generated by coupling an enable signal for Pixel_11, an enable signal for Pixel_12, an enable signal for Pixel_13, . . . , and an enable signal for Pixel_1R.

Specifically, when the 3-bit data value of Pixel_11 is [011] and the 3-bit data value of Pixel_12 to Pixel_1R is [000], the signal which is output to Pixel_11 is high from the time slot 0 to the time slot 2 and is low from the time slot 3 to the time slot 7, and the signal output to Pixel_12 to Pixel_1R is low from the time slot 0 to the time slot 7. Here, the signal output to each pixel may be changed to high or low respectively at a rising time and a falling time of the scanning line selection signal of each pixel. Here, the enable signal for Pixel_11 is high only during the first time interval corresponding to the scanning line selection signals of the first time slot and the fourth time slot, and the enable signal for Pixel_12 to Pixel_1R is low in all time slots. Therefore, the enable signal which is applied to the first row is the same as the enable signal for Pixel_11.

For another example, when the 3-bit data value of Pixel_21 is [011], the signal which is output to Pixel_21 may be high from the time slot 0 to the time slot 2 and may be low from the time slot 3 to the time slot 7. Also, when the 3-bit data value of the Pixel_22 is [010], the signal which is output to the Pixel_22 may be high from the time slot 0 to the time slot 1 and may be low from the time slot 2 to the time slot 7. When the 3-bit data value of Pixel_23 to Pixel_2R is [000], the signal which is output to Pixel_23 to Pixel_2R may be low from the time slot 0 to the time slot 7. Here, the signal which is output to Pixel_22 to Pixel_2R may be changed to "high" or "low" at the rising time or falling time of the scanning line selection signal of each row.

Similarly, enable_2 may be generated by coupling the enable signals for respective pixels included in the second row. That is, the enable signal for Pixel_21 is high only during the first time interval corresponding to the scanning line selection signals of the first time slot and the fourth time slot. The enable signal for Pixel_22 is high only during the second time interval corresponding to the scanning line selection signals of the first time slot and the third time slot. The enable signal for Pixel_23 to Pixel_2R is low in all time slots. Therefore, the enable signal enable_2 which is applied to the second row is obtained by coupling the enable signal for Pixel_21 and the enable signal for Pixel_22.

As described above, the enable signal can be generated according to the data value of each pixel.

FIG. 9 is a logic circuit which generates the enable signal of the display apparatus according to the first embodiment of the present invention.

As described above, the controller may generate an enable signal which is low during the entire time slot in the pixel memory for the pixel having the data value of 0, and may generate an enable signal which is high only during the r-th time interval corresponding to the scanning line selection signals of the first time slot and the (k+1)-th time slot, in the pixel memory for the pixel having the data value of k.

The controller may include a multiplexer and at least one logic circuit. The method for generating the enable signal is performed by a process in which the sequence of each time slot is converted into N bits, each bit is calculated and is input as a selection signal of the multiplexer and a first calculated value which is obtained by calculating an N bit data value and each bit of the sequence of the N bit time slot by at least one logic circuit and a second calculated value which is obtained by calculating by at least one logic circuit are used as an input value of the multiplexer.

Specifically, when the sequence of each time slot is converted into 3 bits, it can be represented as time slot 0=[000], time slot 1=[001], time slot 2=[010], time slot 3=[011], etc. A value obtained by applying each bit T0, T1, and T2 of the time slot to a Not Inverter and by applying the AND gate is defined as a selection signal S. Also, a value obtained by performing an XNOR operation on both each bit D0, D1, and D2 of the N-bit data value and each bit T0, T1, and T2 of the time slot and then by applying the AND gate is defined as the first calculated value, and a value obtained by applying the first calculated value to the Not Inverter is defined as the second calculated value. The first calculated value and the second calculated value can be used as input values A and B of the multiplexer. The controller may generate the enable signal by applying the selection signal S and the two input values A and B to the multiplexer. Here, if the two input values T and D are the same, the result value obtained by passing through the XNOR circuit may be "1", and if the two input values T and D are different from each other, the result value obtained by passing through the XNOR circuit may be "0". That is, when [T0, D0], [T1, D1], and [T2, D2] are [00] or [11], the result value obtained by passing through the XNOR circuit may be "1", and they are different from each other, the result value obtained by passing through the XNOR circuit may be "0".

FIG. 10 is a schematic configuration view of a display apparatus according to a second embodiment of the present invention.

Referring to FIG. 10, the display apparatus according to the second embodiment of the present invention may include a plurality of pixels 110, a plurality of pixel memories 120, and a controller (not shown).

First, the plurality of pixels 210 may be arranged in the form of a matrix of C number of columns and R number of rows. Each pixel 210 has a constant area and may be turned on or off according to a pixel drive signal. The gradation of the pixel can be determined according to the occupation ratio (time or area) of "1" or "0" of each pixel 210. For example, the more "0", the closer the gradation is to black, and the more "1", the closer the gradation is to white. Alternatively, depending on the material constituting each pixel 210 or voltage, conversely the more "0", the closer the gradation is to white, and the more the "1", the closer the gradation is to black.

The plurality of pixel memories 220 are provided for each of the plurality of pixels 210, and when a scanning line selection signal and an enable signal are both selected, a corresponding pixel can be driven by changing an input signal. That is, one pixel memory 220 is provided for each pixel 210, and the r-th scanning line selection signal and the c-th enable signal line are connected to the pixel memory 220 for driving the pixel 210 arranged in the r-th row and the c-th column. Here, when the scanning line selection signal and the enable signal which are applied to the pixel memory 220 are both selected (all signals are "high"), the input signal which is input to the corresponding pixel may be changed from 0 to 1 or from 1 to 0. The plurality of pixel memories 220 may be connected to a common reset signal line to periodically apply a reset signal to each pixel. Each pixel memory 220 may be composed of a T flip-flop, or a D flip-flop and an AND gate.

FIG. 11 is a circuit diagram for schematically describing the operating principle of the pixel memory of the display apparatus according to the second embodiment of the present invention.

Referring to FIG. 11, the pixel memory according to the second embodiment of the present invention can determine an output signal Q of the D flip-flop in accordance with an input signal CLK obtained by applying the scanning line selection signal and the enable signal to the AND gate. Here, when the input signal CLK is "1", the pixel output may be changed (inverted). For example, when the input signal CLK is "1" in a state where the pixel output Q is "0", the pixel output Q is changed into "1", and when the input signal CLK is "0" in a state where the pixel output Q is "1", the pixel output Q is changed into "0". According to the embodiment, the output value may be inverted when a rising pulse is input to the input signal CLK or when a falling pulse is input to the input signal CLK.

The pixel memory can be configured by using the T flip-flop or other pixel elements as well as by using the AND gate and the D flip-flops.

The controller (not shown) generates the scanning line selection signal and the enable signal such that each pixel 210 is driven in a turn-on time occupation ratio corresponding to a data value for each pixel 210. Then, the controller (not shown) may apply the signals to the corresponding pixel memory 220. Specifically, when an initial input signal is set to low and the data value is composed of N bits, the controller divides the time allocated to control each pixel into $2^N$ time slots, and may generate an r-th scanning line selection signal which is high only during the r-th time interval among the time intervals obtained by dividing each time slot equally into R portions. Also, the controller may generate an enable signal which is low during the entire time slot in the pixel memory for the pixel having the data value of 0, and may generate the enable signal which is high only during the time interval corresponding to the scanning line selection signals of the first time slot and the (k+1)-th time slot, in the pixel memory for the pixel having the data value of k. The controller may include a multiplexer and at least one logic circuit. The controller may generate the enable signal by a process in which the sequence of each time slot is converted into N bits, each bit is calculated and is input as a selection signal of the multiplexer and a first calculated value which is obtained by calculating an N bit data value and each bit of the sequence of the N bit time slot by at least one logic circuit and a second calculated value which is obtained by calculating by at least one logic circuit are used as an input value of the multiplexer. The configuration of the controller and the method for generating the enable signal are only examples, and the controller can be configured with various circuit elements may be used, and various methods for generating signals can be used.

Hereinafter, the method for generating the scanning line selection signal, the enable signal, and the pixel input signal and a pixel driving method according to the embodiment of the present invention will be described with reference to the accompanying drawings.

FIG. 12 is a view for describing the pixel drive signal of the display apparatus according to the second embodiment of the present invention.

Referring to FIG. 12, the scanning line selection signal ROW of the display apparatus according to the second embodiment of the present invention is a signal ROW_1 to ROW_R for selecting each row of the plurality of pixels composed of R number of rows and C number of columns. The enable signals enable_1 to enable_c means a control signal for changing output value of the pixel included in the each row in accordance with the data value of the pixel included in each row. In FIG. 11, for convenience, portions corresponding to ROW_3 to ROW_(R−1) are compressed and displayed for each time slot.

The scanning line selection signals ROW_1 to ROW_R is configured to select each row for a 1/R time period obtained by dividing one time slot by R number of rows and to select the next row for the next 1/R time period. When the data value is composed of N bits, the time allocated to control each pixel is divided into $2^N$ time slots to represent the data value by the turn-on time occupation ratio of the pixel. Specifically, when the data value is composed of 3 bits, the time allocated to control each pixel is divided into 8 time slots 0, 1, 2, 3, 4, 5, 6, and 7, so that the pixel can be controlled.

According to the embodiment of the present invention, in order to control each pixel, in the scanning line selection signals ROW_1 to ROW_R for selecting each row, each of the time slots 0, 1, 2, 3, 4, 5, 6 and 7 is equally divided into R portions, and the scanning line selection signal ROW_1 for selecting the first row shows a repeating pattern in which a high signal is output only during the first 1/R time interval of each time slot and a low signal is output during the remaining (R−1)/R time interval. Also, the scanning line selection signal ROW_2 for selecting the second row shows a repeating pattern in which a high signal is output only during the second 1/R time interval of each time slot and a low signal is output during the remaining (R−1)/R time interval. Likewise, the scanning line selection signal ROW_r for selecting the r-th row shows a repeating pattern in which a high signal is output only during the r-th 1/R time interval of each time slot and a low signal is output during the remaining (R−1)/R time interval.

The enable signals enable_1 to enable_C are low signals during the entire time slot when the data value is 0 in accordance with the data value, and are high signals only during the r-th time interval corresponding to the scanning line selection signals of the first time slot and the (k+1)-th time slot in the pixel memory for the pixel having the data value k. Here, the enable signals enable_1 to enable_C may be applied to each column in a form of coupled enable signals to be applied to the plurality of pixels included in the same column. That is, the enable signal enable_1 to be applied to the first column may be generated by coupling an enable signal for Pixel_11, an enable signal for Pixel_12, an enable signal for Pixel_13, . . . , and an enable signal for Pixel_1R. Likewise, the enable signal enable_c to be applied to the c-th column may be generated by coupling an enable signal for Pixel_c1, an enable signal for Pixel_c2, . . . , and an enable signal for Pixel_cR.

Specifically, when the 3-bit data value of Pixel_11 is [011], the signal which is output to Pixel_11 may be output as a signal which is high from the time slot 0 to the time slot 2 and is low from the time slot 3 to the time slot 7. When the 3-bit data value of Pixel_12 to Pixel_1R is [000], the signal which is output to Pixel_12 to Pixel_1R is output as a signal which is low from the time slot 0 to the time slot 7. Here, the enable signal for Pixel_11 is high only during the first time interval corresponding to the scanning line selection signals of the first time slot and the fourth time slot, and the enable signal for Pixel_12 to Pixel_1R is low in all time slots. Therefore, the enable signal which is applied to the first row is the same as the enable signal for Pixel_11. The output signal and the enable signal of each pixel may be changed to "high" or "low" at a rising time and a falling time of the scanning line selection signal of each pixel.

For another example, when the 3-bit data value of Pixel_21 is [001], the signal which is output to Pixel_21 may be high only in the time slot 0 and may be low from the time slot 1 to the time slot 7. Also, when the 3-bit data value of the Pixel_22 is [010], the signal which is output to the Pixel_22 may be high from the time slot 0 to the time slot 1 and may be low from the time slot 2 to the time slot 7. Here, since the output signal and the enable signal of each pixel is changed to "high" or "low" at the rising time and the falling time of the scanning line selection signal of each pixel, the rising time and the falling time of the output signals of Pixel_21 and the Pixel_22 are changed based on the rising time or falling time of the scanning line selection signal of each pixel. When the 3-bit data value of Pixel_23 to Pixel_2R is [000], the signal which is output to Pixel_23 to Pixel_2R may be low from the time slot 0 to the time slot 7.

Therefore, as with the first embodiment, enable_2 may be generated by coupling the enable signals for respective pixels included in the second column. That is, the enable signal for Pixel_21 is high only during the first time interval corresponding to the rising time or falling time of the scanning line selection signals of the first time slot and the second time slot, and the enable signal for Pixel_22 is high only during the second time interval corresponding to the scanning line selection signals of the first time slot and the third time slot. The enable signal for Pixel_23 to Pixel_2R is low in all time slots. Therefore, the enable signal enable_2 which is applied to the second row is obtained by coupling the enable signal for Pixel_21 and the enable signal for Pixel_22.

As described above, the enable signal is generated according to the data value of each pixel, and the turn-on time occupation ratio can be controlled according to the data value of each of the pixels. The scanning line selection signal selects pixels of all the rows and then periodically applies a reset signal to each column, so that the output value remaining in each pixel is removed. Accordingly, the accuracy of the turn-on time occupation ratio of the data value of each pixel can be improved.

According to the embodiments of the present invention, each pixel is driven by applying the common column signal and generating the enable signal such that the output signal appears only in the time slot where the output signal is changed according to the data value, or by applying no common column signal and generating the enable signal such that the output signal appears only in the time slot where the data value of each pixel is changed. Accordingly, power consumption can be reduced by minimizing the total signal change within the display apparatus.

In a Full-HD display, in the simulation of the number of transitions of the column signal line and the number of transitions of the enable signal, assuming that the total ROW lines are 1080 and an image signal is composed of 8 bits, if a pixel at an odd-numbered row has the minimum value "0" of a 8-bit signal and a pixel at an even-numbered row has the minimum value "255" of a 8-bit signal, the number of transitions of the enable signal according to the first embodiment is only 0.8% of the number of transitions of the column signal of FIG. 1, a power consumption reduction of 99% or more can be obtained.

Also, even when each pixel has a random value, power consumption reduction of 97% or more on average can be expected through a large number of simulations.

What is claimed is:

1. A display apparatus comprising:

a plurality of pixels;

a plurality of pixel memories which are provided for the plurality of pixels respectively and drive a corresponding pixel in accordance with a column signal when a scanning line selection signal and an enable signal are both selected; and a controller which generates the scanning line selection signal, the enable signal, and the column signal such that each of the pixels is driven in a turn-on time occupation ratio corresponding to a data value for each of the pixels, and then applies the signals to a corresponding pixel memory;

wherein the plurality of pixels are arranged in the form of a matrix of R number of rows and C number of columns, wherein an r-th scanning line selection signal and a c-th enable signal line are connected to the pixel memory for driving the pixel arranged in an r-th row and a c-th column, and wherein a common column signal line is connected to all the pixel memories, and wherein each of the plurality of pixel memories comprise a first NMOS transistor, a second NMOS transistor, an inverter memory, a third NMOS transistor, and a fourth NMOS transistor which are connected in-series, wherein the scanning line selection signal of the corresponding pixel is applied to gate terminals of the first NMOS transistor and the fourth NMOS transistor, wherein the enable signal of the corresponding pixel is applied to gate terminals of the second NMOS transistor and the third NMOS transistor, wherein a common column signal is applied to a drain terminal of the first NMOS transistor, wherein an inverted common column signal is applied to a source terminal of the fourth NMOS transistor, and wherein a signal temporarily stored in the inverter memory is transmitted to the pixel.

2. The display apparatus of claim 1, wherein, when the data value is composed of N bits, the controller divides time allocated to control each pixel into $2^N$ time slots, and generates the column signal which is high only during a first time slot and an r-th scanning line selection signal which is high only during an r-th time interval among the time intervals obtained by dividing each time slot equally into R portions, and wherein the controller generates the enable signal which is low during the entire time slot in the pixel memory for the pixel having the data value of 0, and generates the enable signal which is high only during the r-th time interval corresponding to the scanning line selection signals of the first time slot and the (k+1)-th time slot, in the pixel memory for the pixel having the data value of k.

3. The display apparatus of claim 1, wherein the controller comprises a multiplexer and at least one logic circuit, and wherein the controller generates the enable signal by a process in which a sequence of each time slot is converted into N bits, each bit is calculated and is input as a selection signal of the multiplexer and a first calculated value which is obtained by calculating an N bit data value and each bit of the sequence of the N bit time slot by at least one logic circuit and a second calculated value which is obtained by calculating by at least one logic circuit are used as an input value of the multiplexer.

* * * * *